US006151462A

United States Patent [19]

Fukuzawa et al.

[11] Patent Number: 6,151,462

[45] Date of Patent: Nov. 21, 2000

[54] HEAT FIXING APPARATUS WHEREIN INFLUENCE OF TEMPERATURE RISE IN SHEET NON-PASSING AREA IS PREVENTED

[75] Inventors: Daizo Fukuzawa, Matsudo; Atsushi Iwasaki, Toride, both of Japan

[73] Assignee: Canon Kabushiki Kaisha, Tokyo, Japan

[21] Appl. No.: 09/140,762

[22] Filed: Aug. 26, 1998

[30] Foreign Application Priority Data

Aug. 28, 1997 [JP] Japan ..... 9-245908

[51] Int. Cl.[7] ..... G03G 15/20

[52] U.S. Cl. ..... 399/67; 399/68

[58] Field of Search ..... 399/33, 45, 67–69, 399/320, 322, 328–332; 219/216

[56] References Cited

U.S. PATENT DOCUMENTS

| | | | |
|---|---|---|---|
| 5,289,247 | 2/1994 | Takano et al. | 355/285 |
| 5,325,166 | 6/1994 | Hamilton et al. | 399/45 |
| 5,365,314 | 11/1994 | Okuda et al. | 355/208 |
| 5,444,521 | 8/1995 | Tomoyuki et al. | 355/285 |
| 5,464,964 | 11/1995 | Okuda et al. | 219/497 |
| 5,552,582 | 9/1996 | Abe et al. | 219/619 |
| 5,552,874 | 9/1996 | Ohtsuka et al. | 355/285 |
| 5,592,276 | 1/1997 | Ohtsuka et al. | 339/335 |
| 5,801,360 | 9/1998 | Oba et al. | 219/216 |
| 5,852,763 | 12/1998 | Okuda et al. | 399/329 |
| 5,915,146 | 6/1999 | Kusaka et al. | 399/68 |

FOREIGN PATENT DOCUMENTS

| | | |
|---|---|---|
| 0 534 417 | 3/1993 | European Pat. Off. . |
| 0 546 545 | 6/1993 | European Pat. Off. . |
| 60-169876 | 9/1985 | Japan . |
| 63-231383 | 9/1988 | Japan . |
| 3-163464 | 7/1991 | Japan . |
| 6-250540 | 9/1994 | Japan . |
| 7-248697 | 9/1995 | Japan . |
| 7-253731 | 11/1995 | Japan . |

OTHER PUBLICATIONS

European Search Report.

*Primary Examiner*—Quana M. Grainger
*Attorney, Agent, or Firm*—Fitzpatrick, Cella, Harper & Scinto

[57] ABSTRACT

A heat fixing apparatus has a pair of movable fixing members for forming a nip; wherein a recording material, bearing an unfixed image, is passed through the nip to fix the unfixed image to the recording material; and a controller for moving the fixing members after a continuous fixing operation for a plurality of recording materials; wherein time of the fixing members being moved after the completion of a continuous fixing operation for a plurality of recording materials of a second size which is smaller than a first size is longer than time of the fixing members being moved after the completion of a continuous fixing operation for a plurality of recording materials of the first size.

17 Claims, 11 Drawing Sheets

HEAT FIXING APPARATUS WHEREIN INFLUENCE OF TEMPERATURE RISE IN SHEET NON-PASSING AREA IS PREVENTED

FIELD OF THE INVENTION AND RELATED ART

The present invention relates to a thermal fixing apparatus, which is employed in an image forming apparatus such as a copying machine or a printer. In particular, the present invention relates to such a thermal fixing apparatus that is capable of processing recording sheets of different sizes: a first size, and a second size which is smaller than the first size.

Some of the image forming apparatuses represented by copying machines or printers employ a thermal fixing apparatus. Prior to the present invention, mainly roller type fixing apparatuses have been known, and been put to practical use. These fixing apparatuses have a rotative cylindrical fixing roller as a fixing member, a rotative cylindrical or columnar pressing roller, and a heater as heating means disposed in the internal space of the fixing roller.

Such roller type fixing apparatuses are structured to perform the following fixing operation. That is, in a fixing operation, a recording sheet which is bearing an unfixed image is processed through a fixing nip, or the interface between the fixing roller and the pressing roller, and while the recording sheet is processed through the fixing nip, heat and pressure is applied to the unfixed image and the recording sheet so that the unfixed image is softened and fused to the recording sheet.

Recently, thermal fixing apparatuses of film types have been proposed as the fixing apparatus for an image forming apparatus, and some of them have been put to practical use. These fixing apparatuses have a fixing film as the fixing member, a cylindrical or columnar pressing roller as the pressure applying member, and a heating member with such a surface that allows the fixing film to slide on, or to move in contact with, the surface.

In the case of a film type fixing apparatus, the fixing film and the heating member are low in thermal capacity. Therefore, the temperature of the fixing nip between the fixing film and the pressure roller rises rather quickly as heat is applied by the heating member. Thus, the power to the heating member is turned on immediately before the recording sheet with a unfixed image enters the fixing nip, so that the energy consumption of the heating member is reduced, and the internal temperature of the image forming apparatus is prevented from rising excessively high.

When a sheet, or a piece, of recording medium (hereinafter, recording sheet) of a small size, such as an ordinary envelope, is processed through a fixing apparatus, the heat from the portions of the fixing members outside the sheet path is not transferred to the recording sheet, and therefore, the temperature of these portions of the fixing members rises in proportion to the amount of the heat which fails to be transferred to the recording sheet. Further, the smaller the recording sheet, the larger the distance between the lateral edges of the recording sheet and the fixing members, making it more difficult for the heat of the fixing members to be robbed by the recording sheet which is being processed through the fixing nip. In other words, the smaller the size of the recording sheet, the greater the increase in temperature in the lateral edge portions of the fixing member. Further, when a recording sheet of a small size, such as an ordinary envelope, is processed through the fixing apparatus, the portions of the nip outside the recording sheet path become smaller in area as the thickness of the recording sheet increases, for example, to the thickness of an ordinary envelope. Therefore, it becomes difficult for the heat of the fixing members to be transferred to the pressure applying member side. Further, as the thickness of the recording sheet increases, the amount of power to be supplied to the heating member must be increased, which further increases the temperature of the fixing member portions outside the recording sheet path.

When a plurality of recording sheets of a small size are continuously processed through a fixing apparatus to fix images, the temperature of the fixing member portions outside the recording sheet path gradually increases. Therefore, if a recording sheet larger than the preceding recording sheets of a small size is processed through the fixing apparatus immediately after the last sheet of the preceding set of recording sheets of a small size is processed, the toner on the larger recording sheet is sometimes excessively melted by the heat from the fixing member portions outside the path of the recording sheets of a small size, and is transferred onto the fixing member; in other words, the so-called "high temperature offset" occurs.

Further, in some image forming apparatuses, the main section of the image forming apparatus, and the fixing apparatus, are driven by a common driving power source. In such image forming apparatuses, the common power source is kept on until the last recording sheet is discharged from the image forming apparatus, and therefore, the fixing member and the pressure applying member continue their rotation even after a fixing operation ends.

These rotations of the fixing members after the completion of a fixing operation (hereinafter, "post-rotation") is useful to reduce the temperature difference between the fixing member portions within the recording sheet path, and the fixing member portions outside the recording sheet path. However, prior to the present invention, the duration of the post-rotation has been set without paying any attention to the size of a sheet of recording medium. Thus, the duration of the post-rotation has not been long enough to sufficiently reduce the aforementioned temperature difference after a plurality of recording sheets of a small size, such as an ordinary envelope, are continuously processed through a fixing apparatus to fix images.

SUMMARY OF THE INVENTION

An object of the present invention is to provide a thermal fixing apparatus capable of preventing the so-called high temperature offset, that is, the phenomenon that an image on a sheet of recording medium is transferred from the sheet of recording medium onto the fixing member of the fixing apparatus due to the high temperature of the fixing member, by reducing the temperature of the fixing member portions outside the path of the preceding set of sheets of recording medium, after the preceding set of sheets of recording medium are continuously processed through the fixing apparatus.

Another object of the present invention is to provide a thermal fixing apparatus which comprises controlling means for moving the fixing members after a continuous fixing operation in which a plurality of recording sheets are processed in succession, and in which the length of the duration the fixing members are kept in motion immediately after the completion of the continuous fixing operation is set to be longer when a plurality of recording sheets of a second size smaller than a first size are processed in succession than when a plurality of recording sheets of the first size are processed in succession.

Another object of the present invention is to provide a thermal fixing apparatus in which immediately after the completion of a fixing operation for processing in succession a plurality of sheets of recording medium with a second size smaller than a first size, the power to the means for increasing the temperature of the fixing member is stopped for a predetermined length of time to suspend the operation of the fixing apparatus.

These and other objects, features and advantages of the present invention will become more apparent upon a consideration of the following description of the preferred embodiments of the present invention, taken in conjunction with the accompanying drawings.

DESCRIPTION OF THE PREFERRED EMBODIMENTS

Hereinafter, the embodiments of the present invention will be described with reference to the drawings.

Figure 11:
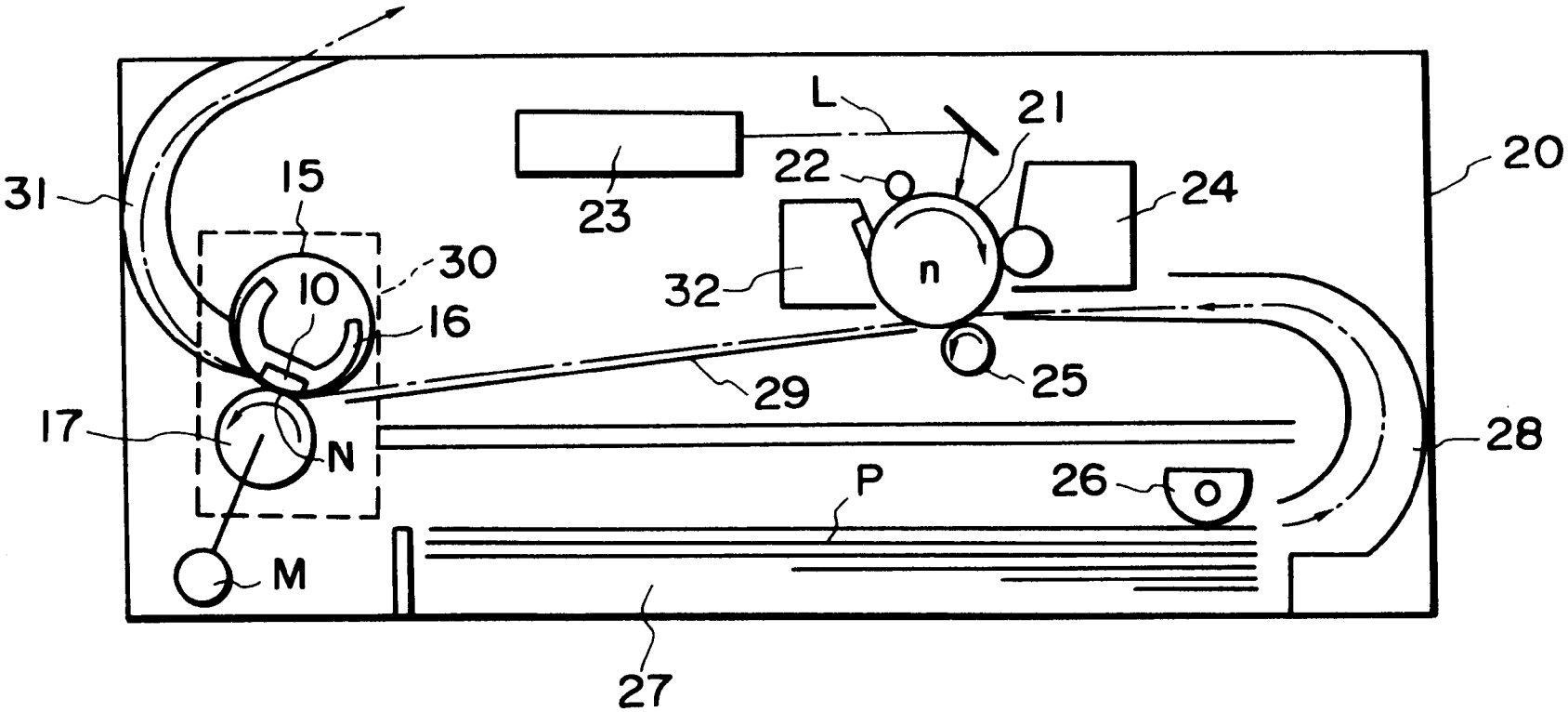
FIG. 11 is a schematic section of an image forming apparatus which employs a thermal fixing apparatus in accordance with the present invention.

FIG. 11 is a schematic section of an image forming apparatus which employs a thermal fixing apparatus in accordance with the present invention. The image forming apparatus in this embodiment is a laser beam based on an electrophotographic process.

A referential FIG. 20 designates an external frame of the apparatus. A referential FIG. 21 designates an electrophotographic photosensitive drum as an image bearing member, which is rotatively driven in the clockwise direction indicated by an arrow mark at a predetermined peripheral velocity (process speed).

As the photosensitive drum 21 is rotatively driven, its peripheral surface is uniformed charged (primary charge) to predetermined polarity and potential level by a charging roller 22. The charged peripheral surface of the photosensitive drum 21 is exposed to a scanning laser beam L which is projected from a laser beam scanner while being modulated with serial digital electrical picture element signals representing the image data of a desired image. As a result, an electrostatic latent image reflecting the image data of the desired image is formed on the peripheral surface of the photosensitive drum 21.

The latent image is developed into a toner image by a developing apparatus 24, and the toner image travels to a transfer nip n between the photosensitive drum 21 and a transferring roller 25.

Meanwhile, recording sheets P in a sheet feeder cassette 27 are fed piece by piece into the image forming apparatus by a sheet feeding roller 26. After being fed into the apparatus, the recording sheet P is sent through a sheet path 28, and is introduced into a transfer nip n with a predetermined timing. In the transfer nip n, an electric field opposite in polarity to the the toner is applied to the recording sheet P from the back side by the transferring roller 25. As a result, the toner image on the photosensitive drum 21 is transferred onto the surface of the recording sheet P.

After receiving the toner image and passing through the transfer nip n, the recording sheet P is separated from the surface of the photosensitive drum 21, and then is guided to a fixing apparatus 30, that is, a type of heating apparatus, by a conveyance guide 29. In the fixing apparatus 30, the toner image is thermally fixed to the recording sheet P. Then, the recording sheet P is discharged from the image forming apparatus through a sheet path 31.

After the transfer of the toner image onto the recording sheet P, the peripheral surface of the photosensitive drum 21 is cleaned by a cleaning apparatus 32, and is used again for image formation; the peripheral surface of the photosensitive drum 21 is repeatedly used for image formation.

Figure 1:
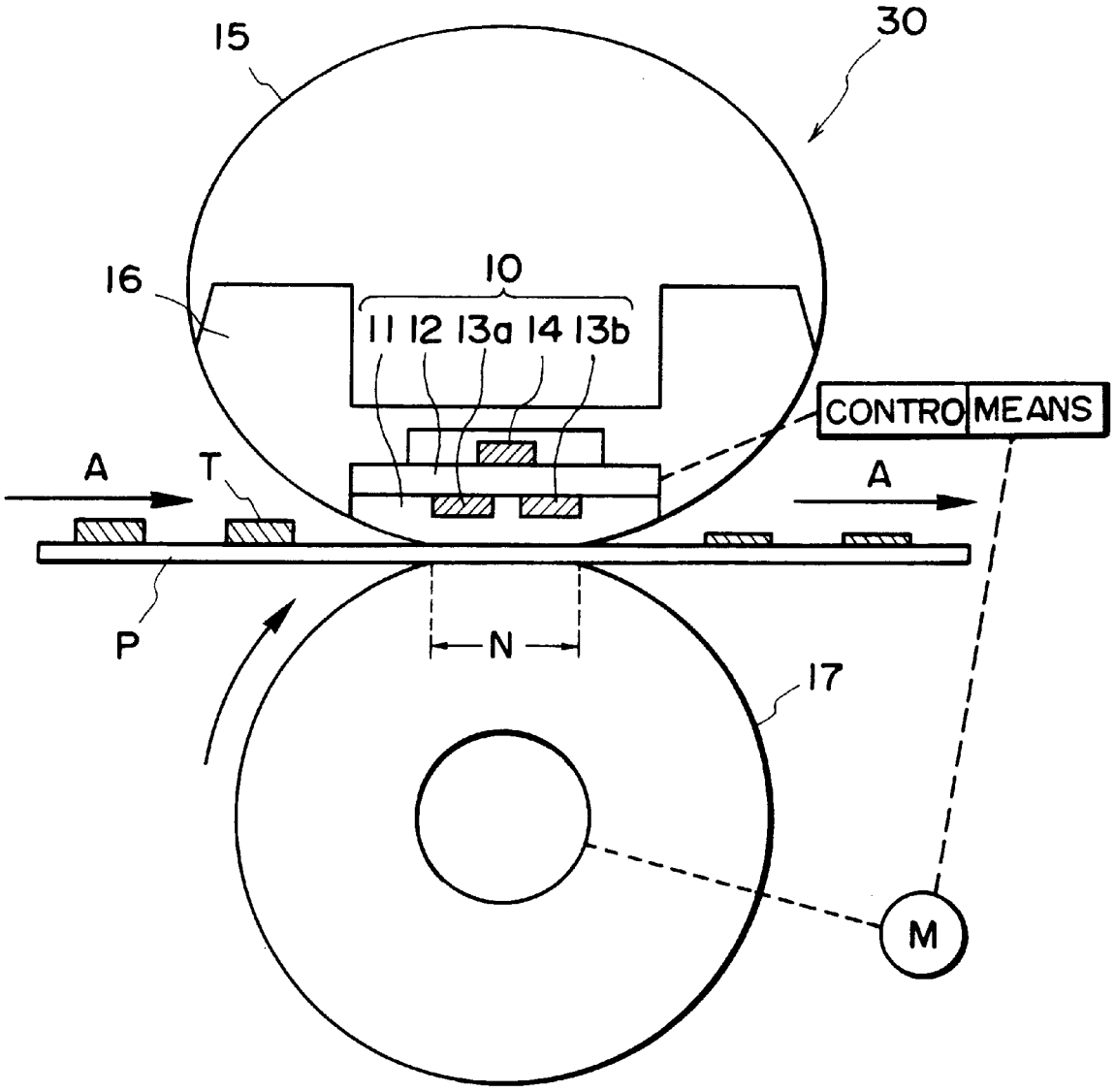
FIG. 1 is a schematic section of the thermal fixing apparatus in accordance with the present invention, and depicts the general structure thereof.

Next, referring to FIG. 1, a film type fixing apparatus, that is, a desirable type of fixing apparatus, to which the control method for an image forming apparatus equipped with a thermal fixing apparatus, in the first embodiment of the present invention, is applicable, will be described. FIG. 1 is a schematic section of a film type fixing apparatus in this embodiment, and depicts its general structure.

As shown in FIG. 1, the film type fixing apparatus in this embodiment comprises a ceramic heater 10 (hereinafter, heater 10), a holder 16, a fixing film 15 (hereinafter, film 15), and a pressing roller 17. The heater 10 constitutes means for increasing the temperature of the film 15, and is approximately rectangular. The holder 16 is a member to which the heater 10 is fixed. The film 15 is fitted around the holder 16. The pressing roller 17 constitutes a pressure applying member. It is rotative, and is columnar or cylindrical.

The heater 10 employed in the above described film type fixing apparatus comprises a flat or virtually flat substrate 12, heat generating resistors 13*a* and 13*b* which generate heat as they receive electrical power, a surface protection layer 11 for protecting the surface of the heater 10, and a temperature sensor 14 of a thermistor type (hereinafter, thermistor 14) for detecting the temperature of the heater 10.

The substrate 12 of the heater 10 extends in the direction perpendicular to the direction (hereinafter, direction A) in which the recording sheet P, on which a unfixed image T is borne, is conveyed. In this embodiment, the length of the heater 10 in terms of its longitudinal direction is 270 mm, and the length of the heater 10 in terms of the direction A is 7.78 mm. The thickness of the heater 10 is 0.635 mm.

The material for the substrate 12 does not need to be limited to specific materials. However, in view of the rapid temperature increase of the heater 10, ceramic materials represented by an alumina or the like, which are heat resistant, electrically insulative, and low in thermal capacity, are desirable.

The heat generating resistors 13*a* and 13*b* of the heater 10 are formed through the following steps. First, electrically resistive paste (resistive paste) represented by silver/palladium, or $Ta_2N$, is coated on one of the surfaces of the substrate 12 in the direction parallel, or virtually parallel, to the longitudinal direction of the substrate 12 by screen printing or the like. Then, they are sintered. In this embodiment, the widths of both the heat generating resistors 13*a* and 13*b* in the direction perpendicular to the longitudinal directions of the substrates 12 are 1 mm, and their thicknesses are 10 $\mu$m.

Both the heat generating resistors 13*a* and 13*b* generate heat as they receive electrical power from a power supply circuit disposed in the image forming apparatus equipped with the film type fixing apparatus in accordance with the present invention. As the heat generating resistors 13*a* and 13*b* generate heat, the heater 10 heats the fixing nip N between the film 15 and the pressing roller 17.

The thermistor 14 of the heater 10 is electrically connected to a temperature control circuit in the image forming apparatus in which the film type fixing apparatus, in accordance with the present invention, is disposed. Thus, in this embodiment, the temperature detected by the thermistor 14 is fed back to the temperature control circuit, and based on this temperature data, the amount of the power to be supplied from the power supply circuit is set by the temperature control circuit so that the temperature of the heater 10 is maintained at a predetermined level. The power to the heater 10 is controlled by controlling means which comprises the power supply circuit and the temperature control circuit.

The film 15 is disposed in the above described film type fixing apparatus, being enabled to slide in contact with the surface of the surface protection layer of the heater 10. In this embodiment, the film 15 is 30 $\mu$m–100 $\mu$m thick, and is composed of mainly polyimide resin in view of the rapid temperature increase.

Although in this embodiment, the main component of the film 15 is polyimide resin, the material for the film 15 does not need to be limited to polyimide resin; all that is required is that the material for the film 15 be heat resistant.

On the other hand, the pressing roller 17 disposed in the film type fixing apparatus comprises an elastic layer (unillustrated) composed of material such as silicone rubber superior in separativeness. It is rotatively supported so that it can be rotatively driven, while pressing upon the outer peripheral surface of the film 15 through the recording sheet P, in the clockwise direction at a predetermined peripheral velocity by a driving mechanism M provided in the image forming apparatus in which the film type fixing apparatus is disposed. As the pressing roller 17 presses upon the heater 10 through the film 15, it forms the fixing nip n.

Thus, the film 15 is caused to follow the rotation of the pressing roller 17 rotatively driven by the driving mechanism M, in contact with the surface protection layer 11 of the heater 10. In a fixing operation, the heat generated by the heat generating resistors 13*a* and 13*b* is first transmitted to the film 15 through the surface protection layer 11, and then, is transmitted from the film 15 to the recording sheet P while the recording sheet P is passed through the fixing nip n. As a result, the unfixed image T is softened and permanently adhered, or fixed, to the recording sheet P by the heat and pressure. After being subjected to the fixation process, the recording sheet P separates from the peripheral surface of the pressing roller 17 due to the curvature of the peripheral surface of the pressing roller 17.

The number, or duration, of the post-rotations of the pressing roller as the pressure applying member disposed in a conventional film type fixing apparatus has been set to be correct for a recording sheet with a size greater than B5 (hereinafter, referred to as normal size sheet or sheet with a first size). Therefore, when a recording sheet of a small size (hereinafter, referred to as a sheet of a small size or a second size), relative to a normal recording sheet, for example, an ordinary envelope, is used, the temperature increase of the film across the portions outside the recording sheet path becomes a problem. Hereinafter, for the sake of the simplicity of the description, such portions of the fixing nip N that are within the path of an ordinary envelope are referred to as the first region, and such portions of the fixing nip N that are outside the ordinary envelope path will be referred to as the second region. When a small size sheet happens to be an ordinary envelope, the amount of the power to the heater 10 is increased because an envelope is equivalent in thickness to two layers of sheet. Therefore, the temperature increase across the portions of the film outside the path of the small size sheets becomes greater.

Thus, in a case that a normal size recording sheet is processed through a conventional film type fixing apparatus immediately after a continuous processing of a plurality of small size recording sheets, the duration of the post-rotations of the pressing roller is not sufficient to allow the temperature distribution at the peripheral surface of the pressing roller to return to the normal distribution. In other words, there remains a substantial amount of temperature difference between the first region, that is, the region within the sheet paths of the preceding small size recording sheets, and the second region, that is the region outside the path of the preceding small size recording sheets, in the fixing nip N, at the time when the normal size sheet begins to enters the fixing nip N.

As a result, the unfixed image borne on the normal size recording sheet sometimes receives an excessive amount of heat across the portions which are passed through the second region, which results in the so-called high temperature offset, that is, a phenomenon that the toner image borne on the normal size recording sheet is transferred from the surface of the normal size recording sheet to the peripheral surface of the fixing film. The frequency or the amount of the high temperature offset increases as the size of the normal size recording sheet increases, or the number of the small size recording sheets processed through the fixing apparatus immediately before the normal size recording sheet increases. Consequently, it becomes impossible to produce an image which precisely reflects a given set of image formation data.

Thus, in this embodiment, in order to solve the problem described above, the mechanism for rotatively driving the pressing roller 17 is controlled by a controlling means in such a manner that the pressing roller 17 is idly rotated a predetermined number of times, or for a predetermined length of time, in the counterclockwise direction (hereinafter, referred to as multiple post-rotations) immediately after a plurality of recording sheets are processed in succession. More specifically, in a case that the sheets processed in a continuous fixing operation immediately before the multiple post-rotations of the pressing roller 17 are of normal size, or in a case that four or less number of small size sheets are continuously processed immediately before the multiple post-rotations, the duration of the multiple post-rotations of the pressing roller 17 is set to 2.25 seconds (predetermined first length of time), whereas in a case that five or more small size sheets are processed in a continuous fixing operation immediately before the multiple post-rotations, the duration of the multiple post-rotations is set to 10 seconds (predetermined second length of time). In this embodiment, the heater 10 is kept on even during the multiple post-rotations of the pressing roller 17.

Figure 2:
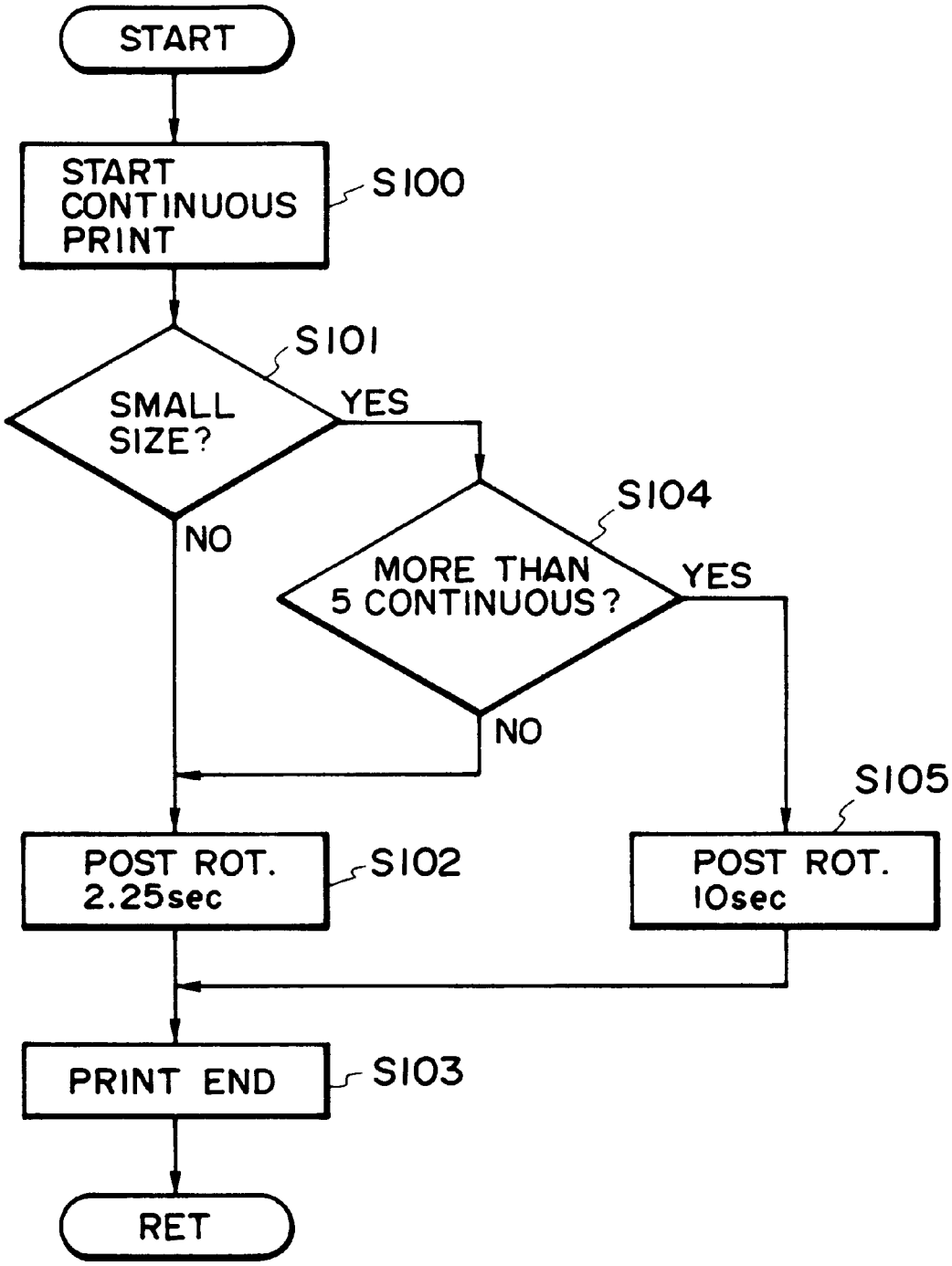
FIG. 2 is a flow chart which describes the first embodiment of the present invention.

At this time, referring to FIG. 2, a method, in this embodiment, for controlling an image forming apparatus equipped with a thermal fixing apparatus will be described. FIG. 2 is a flow chart which shows the steps in the method for controlling the image forming apparatus, in this embodiment.

As a continuous fixing operation for processing a plurality of recording sheets P is started, the heat generating resistors 13*a* and 13*b* generate heat by receiving electric power from the power supply circuit to raise the temperature of the fixing nip N to a predetermined level before the first of the plurality of the recording sheets P enters the fixing nip N, and to maintain the raised temperature until the first recording sheets enters the fixing nip N (Step S100).

Next, before or after the processing of the first recording sheet P in a continuous fixing operation, it is determined whether the recording sheets P in the continuous fixing operation are of a normal size or a small size (Step S101).

If it is determined that the recording sheets P in the continuous fixing operation are of a normal size, the driving mechanism rotates the pressing roller 17 for 2.25 seconds (predetermined first length of time) after the last of the plurality of the normal size recording sheets P is processed (Step S102), and the continuous fixing operation for the plurality of the normal size recording sheets P is ended (Step S103). Then, the fixing apparatus is prepared for processing the first recording sheet P of the next fixing operation.

On the other hand, if it is determined that the recording sheets P processed in a continuous current fixing operation are of a small size, it is next determined whether the number of the small size sheets in the continuous fixing operation is five or more (Step S104). If the number of the small size sheets P is four or less, the driving mechanism rotates the pressing roller 17 for 2.25 seconds (predetermined first length of time) after the fourth small size sheet P is processed (Step S102), and if the number of the small size recording sheets P is five or more, the driving mechanism rotates the pressing roller 17 for 10 seconds (predetermined second length of time) after the last of the small size recording sheets P is processed (Step S105), ending the continuous fixing operation for the plurality of the small size recording sheets P. Then, the fixing apparatus is prepared for the first recording sheet P the following fixing operation.

As is evident the description given above with reference to FIG. 2, the continuous fixing operation ends between Steps S101 and S102, between Steps S104 and Step 102, or between Steps S104 and S105.

Figure 3:
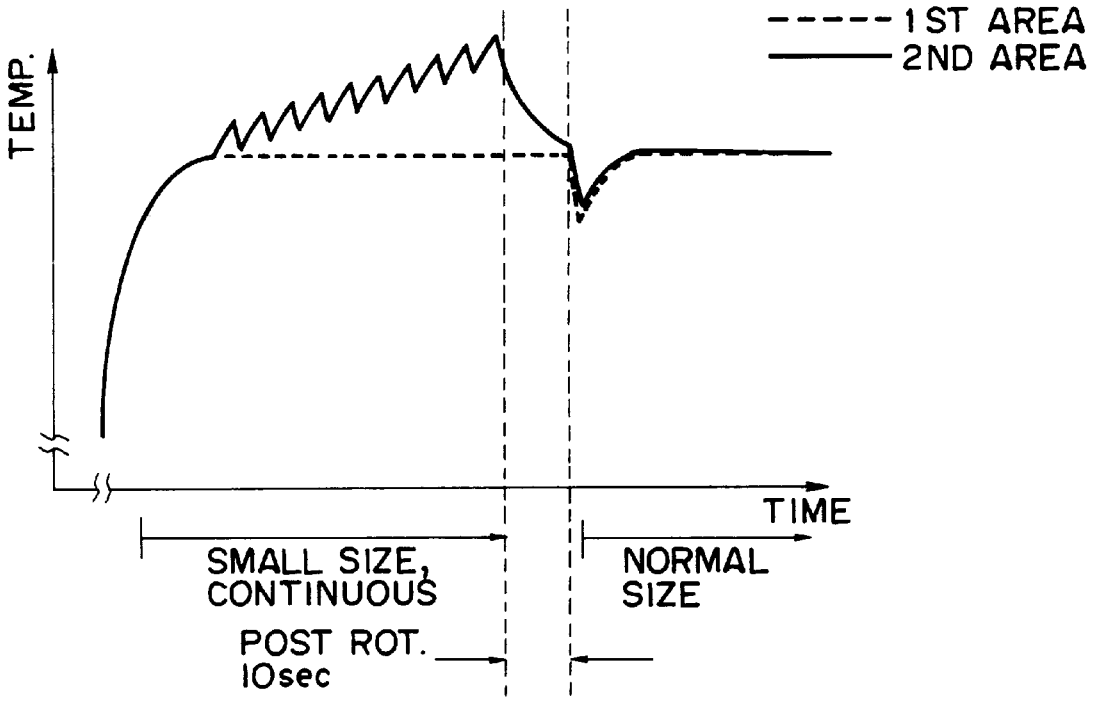
FIG. 3 is a graph which shows the temperature change in the fixing nip in the first embodiment of the present invention.
Figure 4:
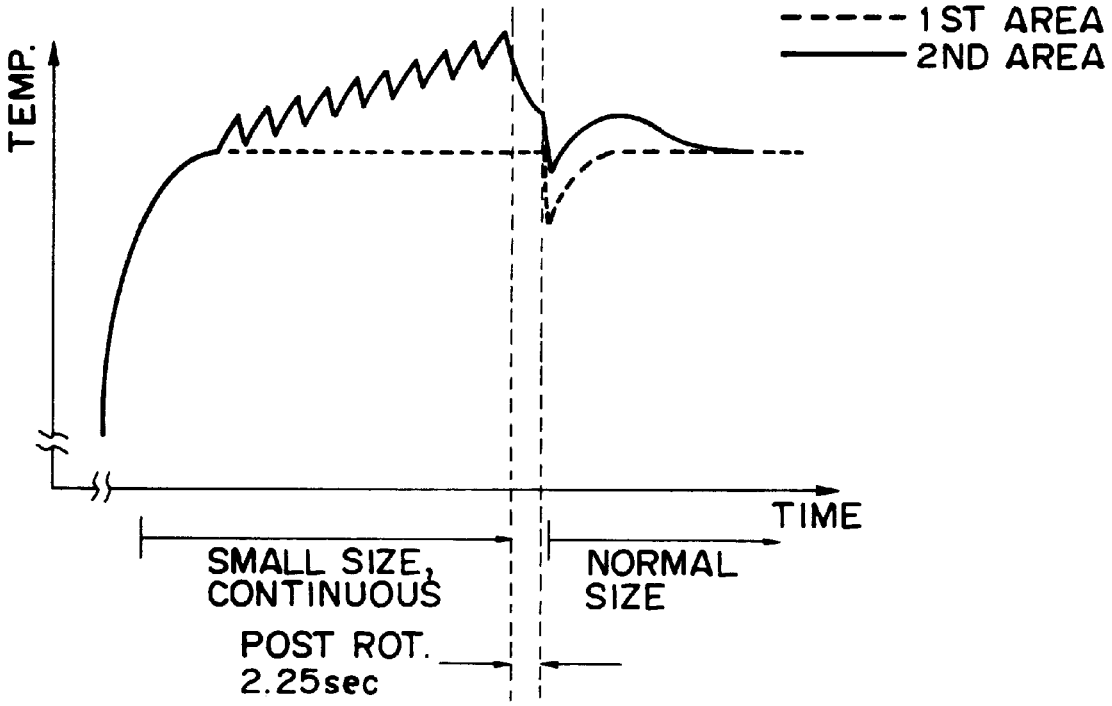
FIG. 4 is a graph which shows the temperature change which occurs in the fixing nip when control is not executed in the first embodiment.

Next, referring to FIGS. 3 and 4, the method, in this embodiment, for controlling the image forming apparatus equipped with a thermal fixing apparatus will be described in terms of the temperature changes in the fixing nip N, which occur when the controlling method in this embodiment is used, and when it is not used. FIG. 3 is a graph which shows the temperature change in the fixing nip N, which occurs when the controlling method is executed. FIG. 4 is a graph which shows the temperature change in the fixing nip N, which occurs when the controlling method is not executed.

Referring to FIG. 3, during a continuous fixing operation for a plurality of small size recording sheets, the first region, that is, the region which falls within the boundary of the path of the small size recording sheet, remains thermally equilibrated because the heat absorption by the recording sheets P balances the heat generation by the heater 10, whereas in the second region, that is, the entire region of the fixing nip N minus the first region, the excessive amount of heat supplied by the heater 10 increases the temperature of the heater 10, film 15, pressing roller 17, and holder 16, creating a temperature difference as high as 50 degrees between the first region and the second region by the time the processing of the last of the small size recording sheets ends.

The graph in FIG. 3 shows the temperature change in the fixing nip N in a continuous fixing operation in which the duration of the multiple post-rotations of the pressing roller 17 after the processing of the last of the small size recording sheets is set to the predetermined second length of time, that is, 10 seconds, substantially longer than the predetermined first length of time, that is, 2.25 seconds, and therefore, by the time the predetermined second length of time elapses after the processing of the last of the small size recording sheets, the temperature difference between the first and the second region is substantially reduced.

On the other hand, the graph in FIG. 4 shows the temperature change in the fixing nip N in a continuous fixing operation in which the duration of the multiple post-rotations of the pressing roller 17 after the processing of the last of the small size sheets is set to the predetermined first length of time, that is, 2.25 seconds, even though the temperature difference between the first region and the second region will have reached as high as 50 degrees after the processing of the last of the small size recording sheets. Therefore, a substantially large temperature difference still remains between the first region and the second region, even after the multiple post-rotations of the pressing roller 17 after the processing of the last of the small size sheets.

In other words, in this embodiment, after a continuous fixing operation for a plurality of normal size recording sheets, the driving mechanism rotates the pressing roller 17 for 2.25 seconds, whereas after a continuous fixing operation for a plurality of small size recording sheets, the driving mechanism rotates the pressing roller 17 for 10 seconds. Therefore, even after a continuous fixing operation for a plurality of small size recording sheets, the temperature difference between the first region, that is, the region within the boundary of the path of the small size recording sheet, and the second region, that is, the entire region of the recording nip N minus the first region, can be reduced by the heat transfer in the axial direction of the pressing roller 17 by the time a normal size recording for forming an image different from the images formed on the small size sheets enters the fixing nip N. Therefore, high temperature offset can be prevented for all recording sheet sizes.

A term "continuous fixing operation" means such a fixing operation that is carried out by a fixing apparatus when images are continuously formed on a plurality of recording sheets by each command for starting an image formation. The command may be directly given to the fixing apparatus.

In the embodiment described above, the rotation of the pressing roller after a continuous fixing operation is controlled in terms of duration in time of rotations. However, it may be controlled in terms of number of rotations.

Further, in the embodiment described above, a step for finding the number of the recording sheets in a continuous fixing operation immediately before the multiple post-rotations of the pressing roller 17 was provided after a step for determining whether the sheets in the continuous fixing operation are of a small size or not. However, in the case that the temperature increase in the region outside the boundary of the path of the small size sheet immediately begins to affect the fixing process, the step for finding the number of the recording sheets in the continuous fixing operation may be omitted.

Further, in the embodiment described above, if the size of a recording sheet is B5 or larger, the duration of the multiple post-rotations of the pressing roller 17 is set to the same length of time as the length of time set for a B5 size recording sheet. However, the duration of the multiple post-rotations for the pressing roller 17 may be rendered longer in accordance with the recording sheet size, or the smaller the recording sheet size, the longer the duration of the multiple post-rotations of the pressing roller 17, as the recording sheet sizes become smaller in the order of A3→B4→A4→B5→ envelope. With this arrangement, the pressing roller 17 is not going to be rotated an unnecessary number of times after a plurality of recording sheets of A3 size, for example, are processed.

Figure 5:
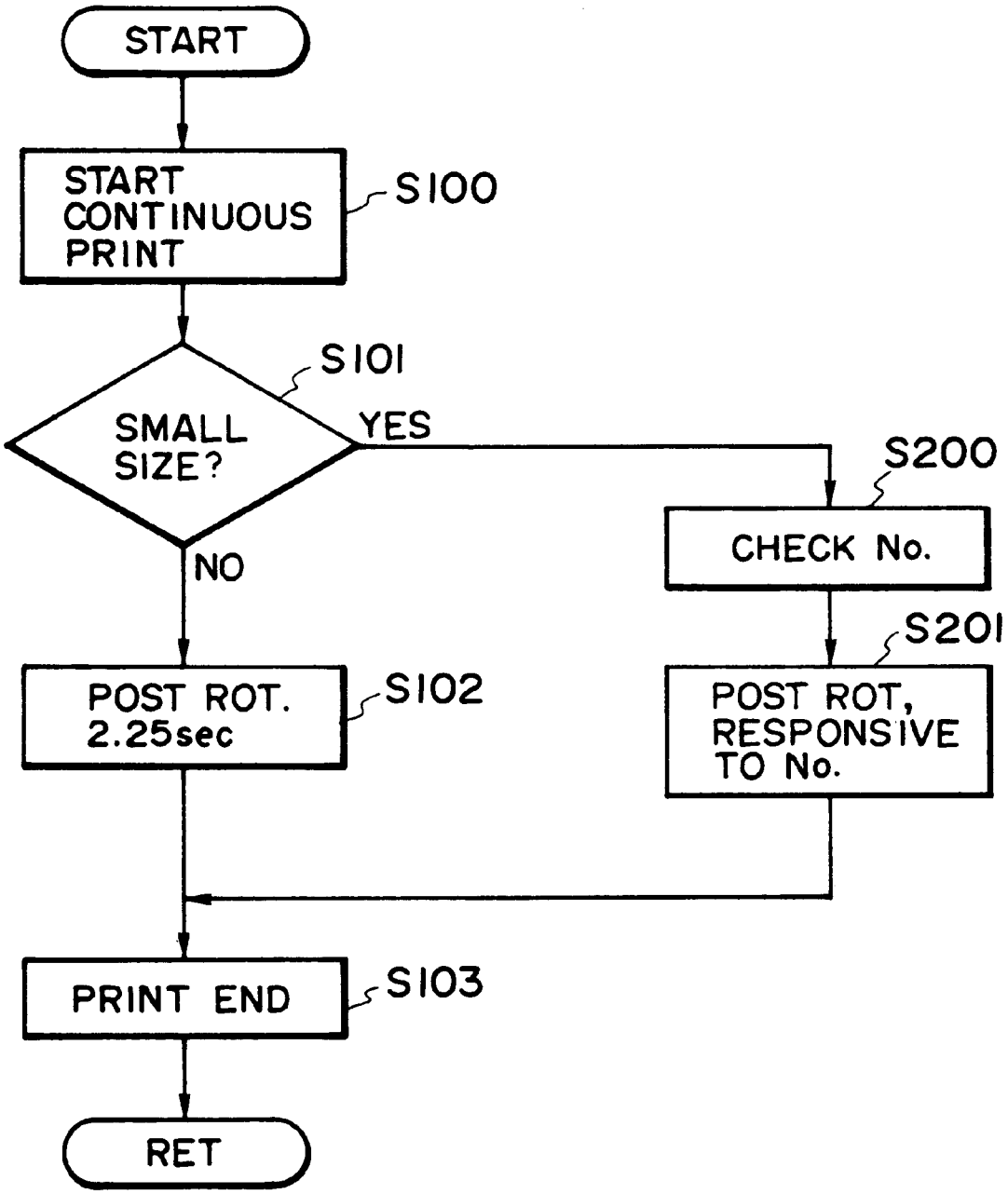
FIG. 5 is a flow chart which describes the second embodiment of the present invention.

Next, referring to FIG. 5, the method for controlling an image forming apparatus equipped with a thermal fixing apparatus, in the second embodiment of the present invention, will be described. FIG. 5 is a flow chart which shows the steps of the image forming apparatus controlling method in this embodiment.

In the method, in this embodiment, for controlling an image forming apparatus equipped with a thermal fixing apparatus, a step, in which the duration (second length of time) for which the driving mechanism rotates the pressing roller 17 after the processing of the last of a plurality of small size recording sheet is changed in accordance with the number of the small size sheets processed in the fixing operation immediately before the multiple post-rotations of the pressing member 17, as shown in Table 1 given below, is introduced. The structure of the fixing apparatus controlled using the method in this embodiment is exactly or substantially the same as the structure of the film type fixing apparatus described in the first embodiment of the present invention with reference to FIG. 1, and therefore, its description will be omitted.

TABLE 1

| Number of small sheets continuously passed (sheets) | Post-rotation period (sec) |
|---|---|
| 1–4 | 2.25 |
| 5–9 | 5 |
| 10–19 | 10 |
| ≧20 | 20 |

Next, referring to FIG. 5, the method for controlling an image forming apparatus equipped with a thermal fixing apparatus, in this embodiment, will be described. In FIG. 5, the control steps, which are the same as the steps in the flow chart in FIG. 2, will be designated with the same referential code, and their description will be omitted.

In the method for controlling an image forming apparatus equipped with a thermal fixing apparatus, in this embodiment, the following steps are introduced. That is, either before or after the first of a plurality of recording sheets P in a continuous fixing operation is processed, it is determined whether the recording sheets P in the continuous fixing operation is of a normal size or a small size (Step S101). If it is determined that the recording sheets P in the continuous fixing operation are of a small size, the number of the small size recording sheets in the continuous fixing operation is confirmed (Step S200). Then, the duration (second length of time) for which the driving mechanism rotates the pressing roller 17 after the processing of the last of the small size recording sheets is set based on the comparison between the confirmed number of the recording sheets of a small size and the categories given in Table 1 (Step S201). FIG. 5 is a flow chart which shows the steps of the control method described above.

In other words, in this embodiment, after the completion of a continuous fixing operation in which a plurality of small size recording sheets are processed, the duration of the multiple post-rotation of the pressing roller 17 is set in accordance with the number of the small size recording sheets continuously processed immediately before the multiple post-rotations of the pressing roller 17, and the driving mechanism rotates the pressing roller 17 for the thus set duration after the continuous fixing operation. Therefore, even after a continuous fixing operation in which a plurality of small size recording sheets are processed, the temperature difference between the first region, that is, the region of the sheet path within the boundary of the path of small size sheet, and the second region, that is, the entire sheet path minus the first region, can be further reduced through heat transfer in the axial direction of the pressing roller 17. Thus, high temperature offset can be prevented for all recording sheet sizes.

Next, the method for controlling an image forming apparatus equipped with a thermal fixing apparatus, in the third embodiment of the present invention, will be described. The structure of the image forming apparatus controlled with the method in this embodiment is exactly or substantially the same as the structure of the film type fixing apparatus described in the first embodiment of the present invention with reference to FIG. 1, and therefore, its description will be omitted.

The method for controlling an image forming apparatus equipped with a thermal fixing apparatus, in this embodiment, comprises substantially the same steps as those in the flow charts in FIGS. 2 and 5, except that in this embodiment the following step is introduced. That is, after a continuous fixing operation in which a plurality of small size sheets are processed, the electrical power to the heat generating resistors 13*a* and 13*b*, which constitute heater 10, is interrupted, while the pressing roller 17 is rotated by the driving mechanism.

Figure 6:
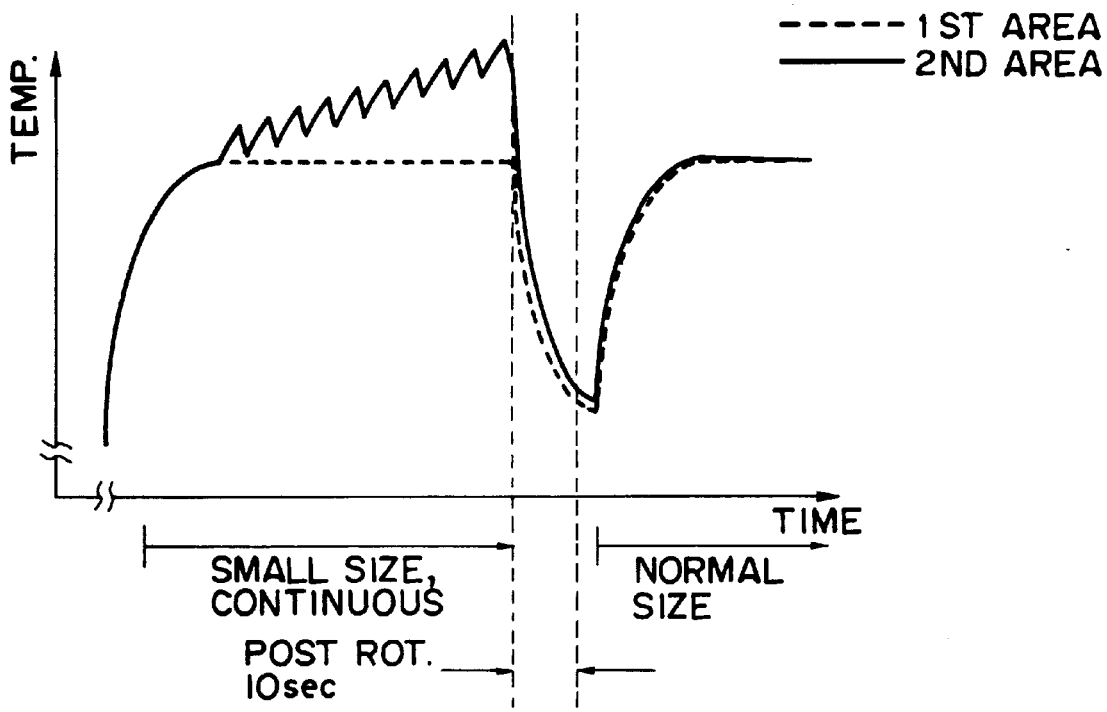
FIG. 6 is a graph which shows the temperature change in the fixing nip in the third embodiment of the present invention.

Next, referring to FIG. 6, the temperature change which occurs in the fixing nip N when the method for controlling an image forming apparatus equipped with a thermal fixing apparatus, in this embodiment, is used, will be described. FIG. 6 is a graph which shows the temperature change which occurs in the fixing nip N when the control method in this embodiment is used.

As is evident from the graph in FIG. 6, in this embodiment, while the pressing roller 17 is rotated after the processing of the last of the small size recording sheets, the power to the heat generating resistors 13*a* and 13*b* which constitute the heater 10 is interrupted. Therefore, the temperature of the first region, that is, the region of the sheet path within the boundary of the path of the small size sheet, and the temperature of the second region, that is, the entire region of the sheet path minus the first region, fall faster, than when the control method for an image forming apparatus equipped with a film type fixing apparatus, in the first embodiment or the second embodiment, is used. Thus, by the time the second length of time for the multiple post-rotations of the pressing roller 17 elapses after the processing of the last of the small size recording sheets, the temperature difference between the first and second regions is further reduced.

In other words, in this embodiment, the heater 10 does not apply heat to the pressing roller 17 at least for the duration of the second multiple post-rotations of the pressing roller 17. Therefore, even after a continuous fixing operation in which a plurality of small size sheets are processed, the temperature difference between the first region, that is, the region of the sheet recording sheet path, within the boundary of the sheet path of the small size recording sheet, and the second region, that is, the entire region of the sheet path minus the first region, is reduced by the heat conduction in the axial direction of the pressing roller 17. Thus, high temperature offset can be prevented for all recording sheet sizes.

Next, the method for controlling an image forming apparatus equipped with a thermal fixing apparatus, in the fourth embodiment of the present invention, will be described. The structure of the image forming apparatus controlled with the method in this embodiment is exactly or substantially the same as the structure of the film type fixing apparatus described in the first embodiment of the present invention with reference to FIG. 1, and therefore, its description will be omitted.

The method for controlling an image forming apparatus equipped with a thermal fixing apparatus, in this embodiment, comprises substantially the same steps as those in one of the first to third embodiments, except that in this embodiment the following step is introduced. That is, the peripheral velocity at which the pressing roller 17 is rotated for the second length of time for the multiple post-rotations is set to 70 rpm (second peripheral velocity), which is much faster than a peripheral velocity of 54 rpm (first peripheral velocity), to which the peripheral velocity at which the pressing roller 17 is rotated for the predetermined first length of time for the multiple post-rotations, is set.

The control method for an image forming apparatus equipped with a thermal fixing apparatus, in this embodiment, is more effective when it is used with an image forming apparatus in which the pressing roller 17 is rotatively driven by a driving mechanism separate from the driving mechanisms for driving the other components in the image forming apparatus.

Figure 7:
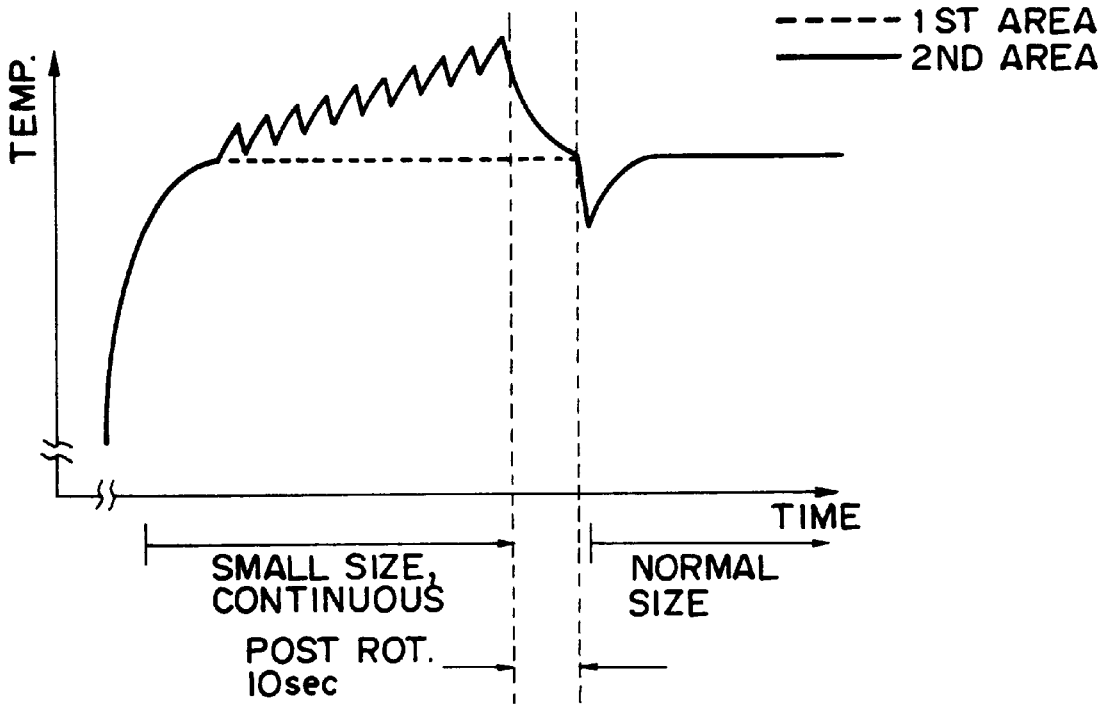
FIG. 7 is a graph which shows the temperature change in the fixing nip in the fourth embodiment of the present invention.

Next, referring to FIG. 7, the temperature change which occurs in the fixing nip N when the control method for a image forming apparatus equipped with a thermal fixing apparatus, in this embodiment, is used, will be described. FIG. 7 is a graph which shows the temperature change in the fixing nip N which occurs when the control method described above is used.

As is evident from FIG. 7, in this embodiment, after the processing of the last of the small size sheets, the peripheral velocity of the pressing roller 17 is switched from 54 rpm to 70 rpm, that is, the driving mechanism rotates the pressing roller 17 at 70 rpm during the second multiple post-rotations of the pressing roller 17. Therefore, the heat conduction from the heater 10 to the film 15 and the pressing roller 17 improves, radiating faster the excessive heat into the surrounding areas of the fixing nip N and the like. Thus, by the time the second length of time for the multiple post-rotations of the pressing roller 17 elapses after the processing of the last of the small size recording sheets, the temperature difference between the first region, that is, the region of the sheet path within the boundary of the sheet path of the small size sheet, and the second region, that is, the entire sheet path minus the first region, is further reduced.

In other words, in this embodiment, the driving mechanism rotates the pressing roller 17 at a peripheral velocity of 70 rpm during the second multiple post-rotations, increasing the contact between the pressing roller 17 and the film 15, in terms of cumulative contact area, in comparison to the contact between the pressing roller 17 and the film 15, in terms of cumulative contact area, during the first multiple post-rotations. Therefore, even after a continuous fixing operation in which a plurality of small size recording sheets are processed, the temperature difference between the first region, that is, the region of the sheet path within the boundary of the path of the small size sheet, and the second region, that is, the entire region of the sheet path minus the first region, is quickly reduced through the heat conduction in the axial direction of the pressing roller 17. Thus, high temperature offset is prevented for recording sheets of all sizes.

Figure 8:
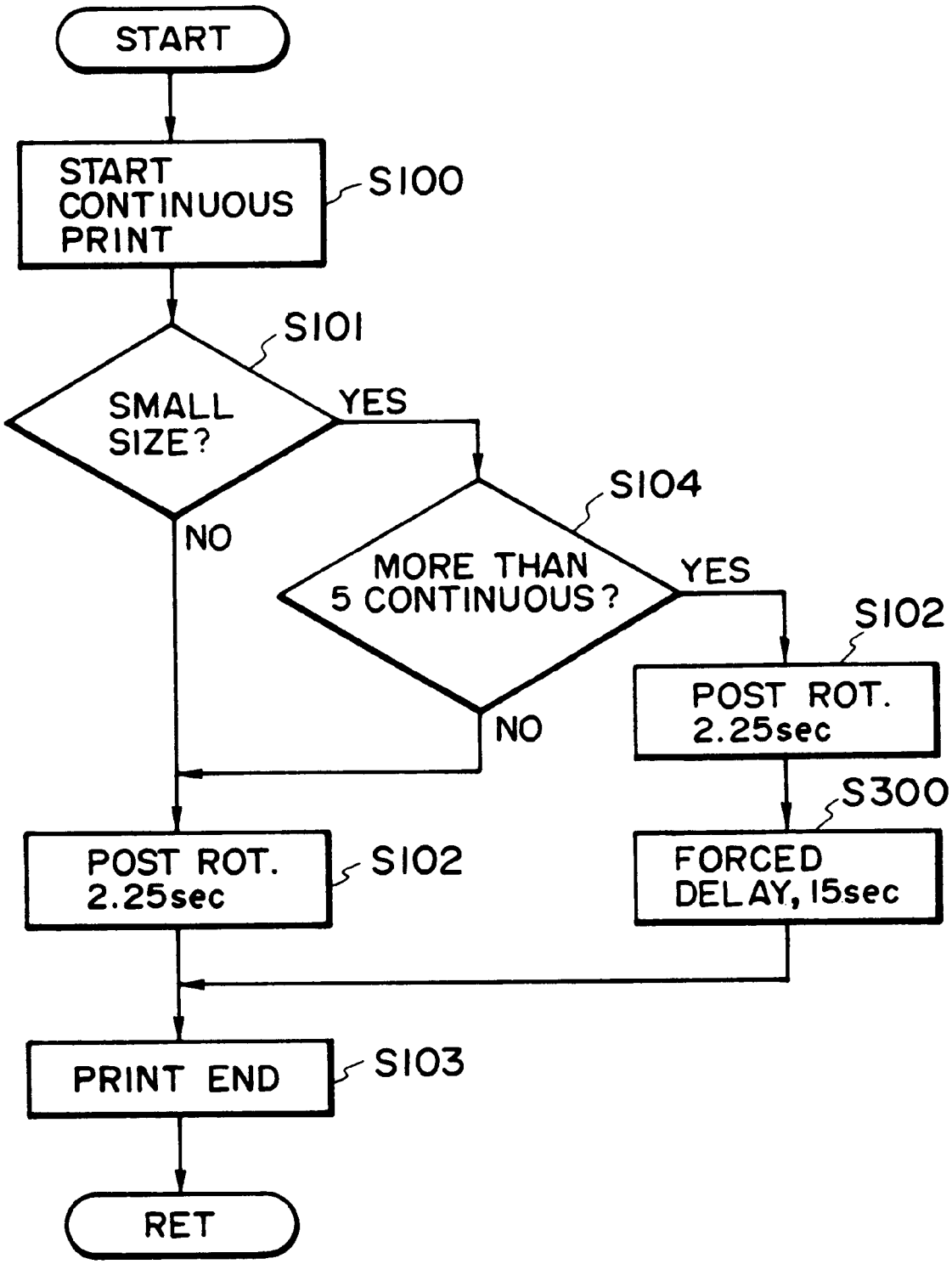
FIG. 8 is a flow chart which describes the fifth embodiment of the present invention.

Next, referring to FIG. 8, the control method for an image forming apparatus equipped with a thermal fixing apparatus, in the fifth embodiment of the present invention, will be described. FIG. 8 is a flow chart which shows the steps in the control method described above.

In the control method for an image forming apparatus equipped with a thermal fixing apparatus, in this embodiment, the following control step is introduced. That is, after a continuous fixing operation in which a plurality of recording sheets P are processed, the driving mechanism rotates the pressing roller 17 for 2.25 seconds (predetermined first length of time). In particular, after a continuous fixing operation in which a plurality of small size sheets are processed, the driving mechanism rotates the pressing roller 17 for 2.25 seconds (predetermined first length of time), and thereafter, the thermal fixing apparatus is shut off for a predetermined length of 15 seconds.

While the thermal fixing apparatus is shut off, the power to the heater 10 is interrupted, and the pressing roller 17 is not driven, to prevent a fixing operation from being carried out.

The structure of the thermal fixing apparatus controlled using the control method in this embodiment is exactly or substantially the same as the structure of the film type fixing apparatus described in the first embodiment with reference to FIG. 1, and therefore, its description will be omitted.

Next, referring to FIG. 8, the control method for an image forming apparatus equipped with a thermal fixing apparatus, in this embodiment, will be described. In FIG. 8, the control steps, which are the same as the steps of the flow chart in FIG. 2, are designated by the same referential codes, and their description will be omitted.

As is evident from the flow chart, in the control method for an image forming apparatus equipped with a thermal fixing apparatus, in this embodiment, before or after the processing of the first recording sheet P in a continuous fixing operation is processed, it is determined whether the recording sheets P in the continuous fixing operation are of a normal size or a small size (Step S101). If it is determined that the recording sheets P are of a small size, it is next determined whether the number of the small size sheets in the continuous fixing operation is five or more (Step S104). If the number of the small size sheets P is four or less, the driving mechanism rotates the pressing roller 17 for 2.25 seconds (predetermined length of time) after the fourth small size sheet P is processed (Step S102), ending the continuous fixing operation for the plurality of small size sheets (Step S103), and the apparatus is prepared for the next recording sheet P. If the number of the small size recording sheets P is five or more, the driving mechanism rotates the pressing roller 17 for 2.5 seconds (predetermined length of time) after the last of the small size recording sheets P is processed (Step S102), and thereafter, the fixing apparatus is shut off for 15 seconds (Step S300), ending the continuous fixing operation for the plurality of the small size recording sheets P. Then, the fixing apparatus is prepared for the following recording sheet P. FIG. 8 is a flow chart which shows the steps of the control method described above.

Figure 9:
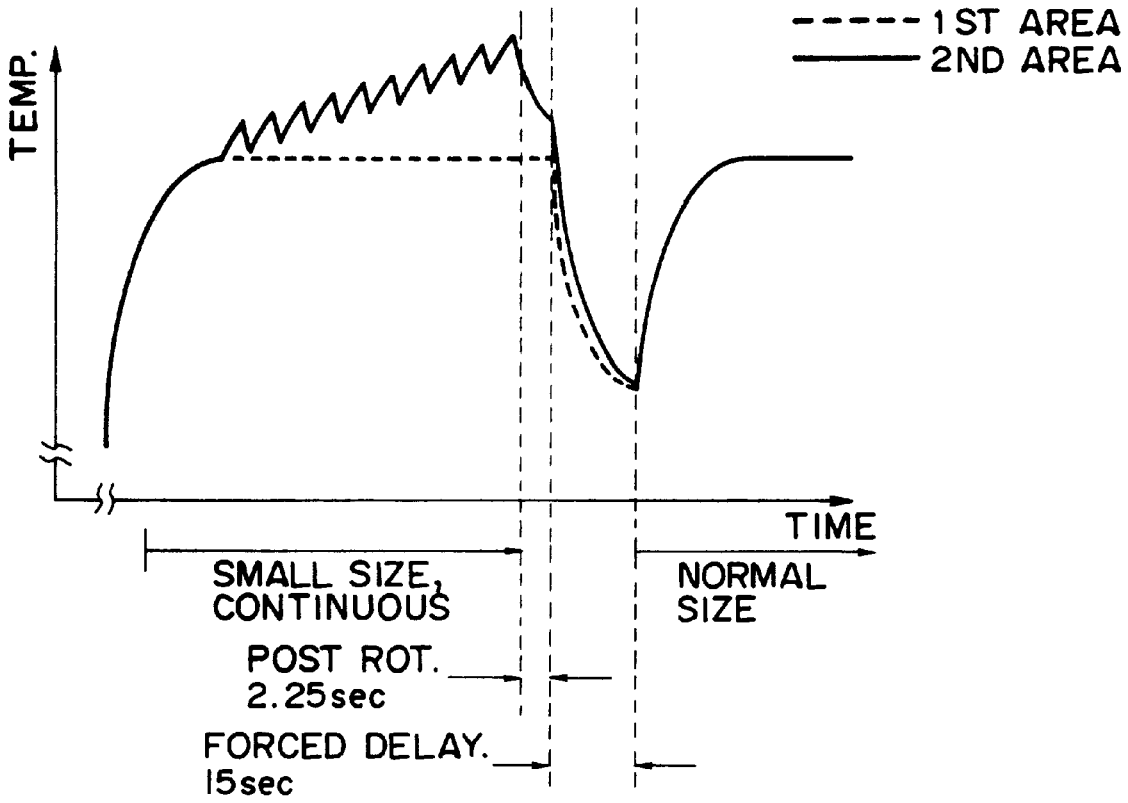
FIG. 9 is a graph which shows the temperature change in the fixing nip in the fifth embodiment of the present invention.

Next, referring to FIG. 9, the temperature change in the fixing nip N which occurs when the control method for an image forming apparatus equipped with a thermal fixing apparatus, in this embodiment, will be described. FIG. 9 is a graph which shows the temperature change in the fixing nip N which occurs when the control method described above is used.

As is evident from FIG. 9, in a continuous fixing operation in which a plurality of small size sheets are processed, the first region, that is, the region of the sheet path within the boundary of the sheet path of the small size sheet, remains thermally equilibrated because the heat absorption by the small size sheets P balances the heat generation by the heater 10, whereas in the second region, that is, the entire region of the sheet path minus the first region, the excessive amount of heat supplied by the heater 10 increases the temperature of the heater 10, film 15, pressing roller 17, and holder 16, and therefore, at the end of the 2.25 seconds of the multiple post-rotations of the pressing roller 17 after the continuous fixing operation for the plurality of small size sheets, there remains a significant amount of temperature difference between the first and second regions.

However, in this embodiment, after the continuous fixing operation for the plurality of small size sheets, the driving mechanism rotates the pressing roller 17 for 2.25 seconds, and thereafter, the thermal fixing apparatus is shut off for 15 seconds. Therefore, by the time the next fixing operation is started, the temperature difference between the first and second regions is reduced to an insignificant level.

In other words, in this embodiment, after a continuous fixing operation for a plurality of small size sheets, the driving mechanism rotates the pressing roller 17 for 2.25 seconds, and thereafter, the thermal fixing apparatus is shut off for 15 seconds. Therefore, even after the continuous fixing operation for the plurality of small size sheets, the temperature difference between the first region, that is, the sheet path within the boundary of the path of the small sheet, and the second region, that is, the entire region of the sheet path minus the first region, reduces to an insignificant level due to the heat conduction in the axial direction of the pressing roller 17 which occurs during the 15 seconds the thermal fixing apparatus is shut off, by the time the next fixing operation is started. Thus, high temperature offset is prevented for all recording sheet sizes.

Figure 10:
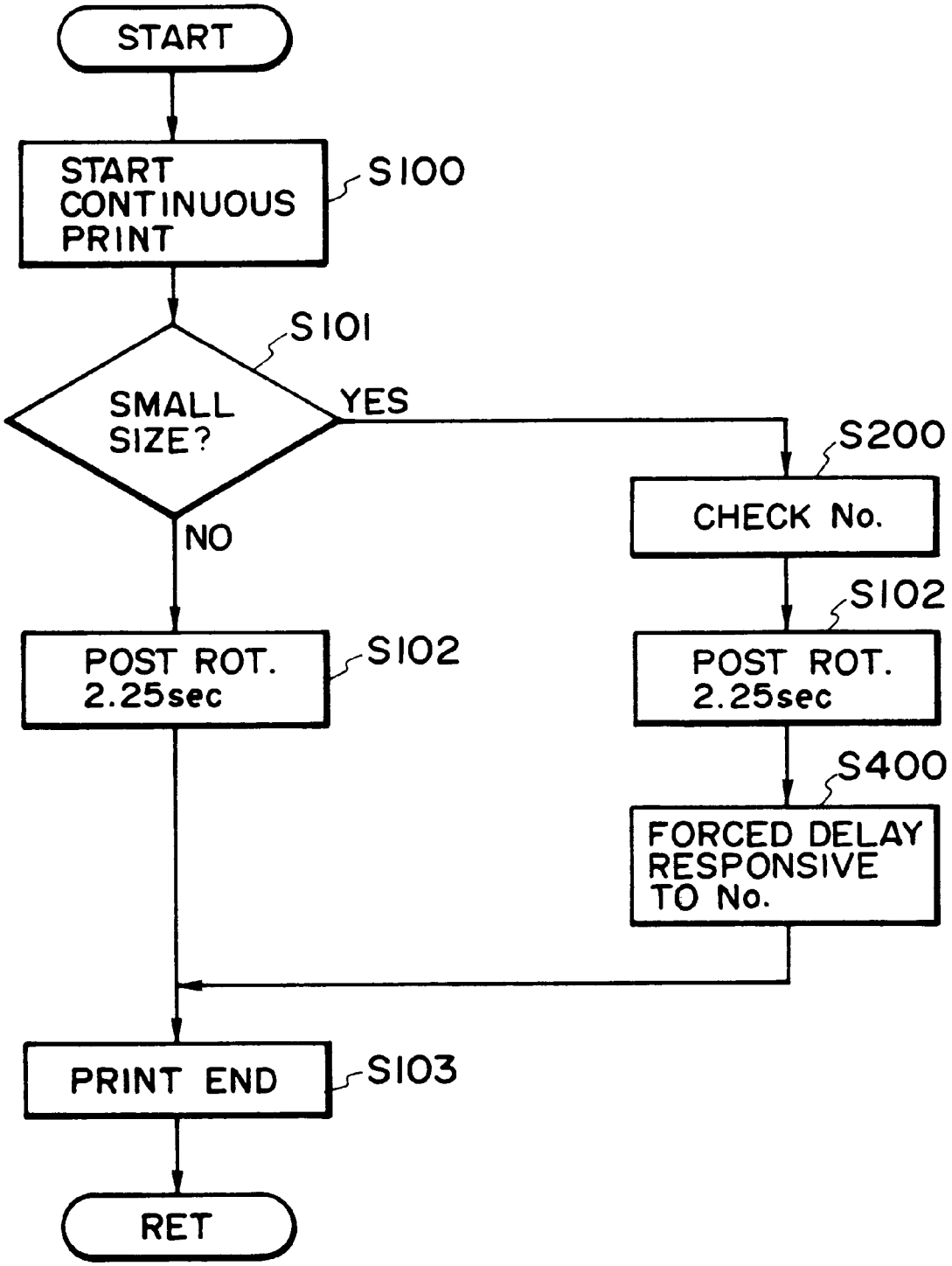
FIG. 10 is a flow chart which describes the sixth embodiment of the present invention.

Next, the control method for an image forming apparatus equipped with a thermal fixing apparatus, in the sixth embodiment of the present invention, will be described with reference to FIG. 10. FIG. 10 is a flow chart which shows the steps in the control method in this embodiment.

In the control method for an image forming apparatus equipped with a thermal fixing apparatus, in this embodiment, the following step is introduced. That is, the length of time the thermal fixing apparatus is shut off after the completion of the multiple post-rotations is changed in accordance with the number of the small size sheets processed in a continuous fixing operation, as shown in Table 2 given below. The thermal fixing apparatus controlled using the control method in this embodiment is structured exactly or substantially the same as the film type fixing apparatus described in the first embodiment with reference to FIG. 1, and therefore, its description will be omitted.

TABLE 2

| Number of small sheets continuously passed (sheets) | Forced waiting time (sec) |
|---|---|
| 1–4 | 0 |
| 5–9 | 8 |
| 10–19 | 15 |
| ≧20 | 25 |

Next, the steps in the control method for an image forming apparatus equipped with a thermal fixing apparatus, in this embodiment, will be described with reference to FIG. 10. In FIG. 10, the steps, which are the same as those in the flow chart in FIG. 5 or 8 are given the same referential codes, and their description will be omitted.

As shown in FIG. 10, according to the control method for an image forming apparatus equipped with a thermal fixing apparatus, in this embodiment, first, before or after the processing of the first recording sheet P in a continuous fixing operation, it is determined whether the recording sheet P is of a normal size or a small size (Step S101). If it is determined that the recording sheet P is of a small size, the count of the small size sheets in the continuous fixing operation, is confirmed (Step S200). Next, the continuous fixing apparatus for a plurality of normal size sheets is ended (Step S103), and the fixing apparatus is prepared for processing the following recording sheet P. After a continuous fixing operation for five or more small size sheets, the driving mechanism rotates for 2.25 seconds (Step S102), and then, the thermal fixing apparatus is shut off for a specific length of time selected based on the comparison of the confirmed count of the small size sheets to the categories given in Table 2 (Step S400), ending the continuous fixing operation for the small size sheets (Step S103), and the thermal fixing apparatus is prepared for the fixing operation for the following recording sheet P. FIG. 10 is a flow chart which shows the control steps in the control method described above.

In other words, in this embodiment, after a continuous fixing operation for a plurality of small size sheets, a specific length of time the thermal fixing apparatus is shut off is selected based on the count of small size sheets in a continuous fixing operation, and the thermal fixing apparatus is shut off for the selected length of time. Therefore, the temperature difference between the first region, that is, the region of the sheet path within the boundary of where the small size sheets have passed, and the second region, that is, the entire sheet path minus the first region, is further reduced by the time the first of the normal size recording sheets to be processed in the following fixing operation, enters the fixing nip N, due to the heat conduction in the axial direction of the pressing roller which occurs for the specific length of time set based on the count of the small size sheets processed in a continuous fixing operation. Thus, high temperature offset is prevented for all recording sheet sizes.

While the invention has been described with reference to the structures disclosed herein, it is not confined to the details set forth, and this application is intended to cover such modifications or changes as may come within the purposes of the improvements or the scope of the following claims.

What is claimed is:

1. A heat fixing apparatus comprising:

a pair of movable fixing members for forming a nip;

wherein a recording material, bearing an unfixed image, is passed through said nip to fix by heat the unfixed image to the recording material; and controlling means for moving said fixing members after completion of a continuous fixing operation for a plurality of recording materials;

wherein a period of said fixing members being moved after the completion of a continuous fixing operation for a plurality of recording materials of a second size which is smaller than a first size is longer than a period of said fixing members being moved after the completion of a continuous fixing operation for a plurality of recording materials of the first size, irrespective of a setting of a next fixing operation.

2. A fixing apparatus according to claim 1, wherein the period is a time period.

3. A fixing apparatus according to claim 1, wherein said fixing members includes a rotatable member, and the period corresponds to a number of rotations of the rotatable member.

4. A fixing apparatus according to claim 1, wherein when a count of recording materials continuously processed in a fixing operation is no less than a predetermined number, that the period of said fixing members being moved after the completion of a continuous fixing operation for the recording materials of the second size is longer than the period of said fixing members being moved after the completion of a continuous fixing operation for the recording materials of the first size.

5. A fixing apparatus according to claim 1, wherein the period of said fixing members being moved after the completion of a continuous fixing operation for the recording materials of the second size is changed based on a count of the recording material processed before the movement of said fixing members is started.

6. A fixing apparatus according to claim 1, further comprising means for raising the temperature of said fixing members by being supplied with electric power;

wherein the power to said temperature raising means is interrupted while said fixing members are moved after the completion of a continuous fixing operation for the recording materials of said second size.

7. A fixing apparatus according to claim 6, wherein said temperature raising means includes a heater.

8. A fixing apparatus according to claim 1, wherein a speed at which said fixing members are moved after the completion of a continuous fixing operation for the recording materials of said second size is greater than a speed at which said pair of fixing members are moved after the completion of a continuous fixing operation for the recording materials of said first size.

9. A fixing apparatus accordance with claim 1, wherein the recording material of said second size is an envelope.

10. A fixing apparatus according to claim 1, wherein one of said pair of fixing members is an endless film, within a loop of which a heater is disposed, and an other of said pair of fixing members is a roller which presses upon said heater through said film.

11. A fixing apparatus comprising:

a pair of movable fixing members for forming a nip;

means for raising the temperature of said fixing members by supplying electric power; and wherein a recording material of a first size, or a recording material of a second size which is smaller than the first size, bearing an unfixed image, is passed through said nip to fix by heat the unfixed image to the recording material;

wherein after the completion of a continuous fixing operation for a plurality of recording materials of the second size, the electric power supply to said temperature raising means is stopped, and the fixing operation is prohibited, for a predetermined period, irrespective of setting of a next fixing operation.

12. A fixing apparatus according to claim 11, wherein said period is a time period.

13. A fixing apparatus according to claim 11, wherein prohibition of the fixing operation is effected after said fixing members are moved through a predetermined time after the completion of a continuous fixing operation for the recording materials of said second size.

14. A fixing apparatus according to claim 11, wherein the period is changed in accordance with a count of the recording materials in a continuous fixing operation carried out before the prohibition of the fixing operation.

15. A fixing apparatus according to claim 11, wherein the recording material of said second size is an envelope.

16. A fixing apparatus according to claim 11, wherein said temperature raising means includes a heater.

17. A fixing apparatus according to claim 11, wherein one of said pair of fixing members is an endless film, within a loop of which a heater is disposed, and an other of said pair of fixing members is a roller which presses upon said heater through said film.

* * * * *

UNITED STATES PATENT AND TRADEMARK OFFICE

CERTIFICATE OF CORRECTION

PATENT NO. : 6,151,462
DATED : November 21, 2000
INVENTOR(S) : Daizo Fukuzawa, et al.

It is certified that error appears in the above-identified patent and that said Letters Patent is hereby corrected as shown below:

Column 1:
Line 45, "a unfixed" should read -- an unfixed --.

Column 4:
Line 61, "a unfixed" should read -- an unfixed --.

Column 7:
Line 53, "evident" should read -- evident from --.

Column 8:
Line 47, "sheet," should read -- sheets, --.

Column 9:
Line 5, "sheet," should read -- sheets --.
Line 34, "sheet," should read -- sheets --.
Line 67, "is of" should read -- are of --.

Column 10:
Line 63, "sheet," should read -- sheets, --.

Column 11:
Line 14, "sheet," should read -- sheets, --.
Line 50, "for a" should read -- for an --.

Column 12:
Line 3, "sheet," should read -- sheets, --.
Line 16, "sheet," should read -- sheets, --.

UNITED STATES PATENT AND TRADEMARK OFFICE

CERTIFICATE OF CORRECTION

PATENT NO. : 6,151,462
DATED : November 21, 2000
INVENTOR(S) : Daizo Fukuzawa, et al.

It is certified that error appears in the above-identified patent and that said Letters Patent is hereby corrected as shown below:

Column 15:
Line 25, "includes" should read -- include --.

Column 16:
Line 8, "accordance with" should read -- according to --.
Line 12, "an other" should read -- another --.
Line 48, "an other" should read -- another --.

Signed and Sealed this

Second Day of October, 2001

*Attest:*

Nicholas P. Godici

*Attesting Officer*

NICHOLAS P. GODICI
*Acting Director of the United States Patent and Trademark Office*